United States Patent [19]

Glatz

[11] Patent Number: 4,674,523

[45] Date of Patent: Jun. 23, 1987

[54] SUSPENSION UMBRELLA WITH BALL JOINT SECURING DEVICE

[75] Inventor: Gustav A. Glatz, Frauenfeld, Switzerland

[73] Assignee: Glatz AG, Switzerland

[21] Appl. No.: 767,766

[22] Filed: Aug. 21, 1985

[30] Foreign Application Priority Data

Sep. 7, 1984 [CH] Switzerland ..... 4284/84

[51] Int. Cl.[4] ..... A45B 17/00; E04H 15/04; F16 3/00

[52] U.S. Cl. ..... 135/21; 135/90; 135/DIG. 9; 403/125

[58] Field of Search ..... 135/21, 20 A, 84, 112, 135/20 R, 20 M, 90, 113, 114; 403/13, 90, 122, 125, 114, 115, 249, 362, 3 R, 330, 136, 137, 148; 294/96; 29/808

[56] References Cited

U.S. PATENT DOCUMENTS

| | | | |
|---|---|---|---|
| 596,490 | 1/1898 | Edwards | 135/114 X |
| 1,067,367 | 7/1913 | Noster | 403/330 |
| 1,628,914 | 5/1927 | Ridenour | 403/137 |
| 1,671,991 | 6/1928 | Lindner | 403/115 X |
| 1,883,782 | 10/1932 | Graham | 403/137 |
| 1,996,071 | 4/1935 | Kahn | 135/20 R |
| 2,496,769 | 2/1950 | Battle | 135/20 R |
| 2,767,723 | 10/1956 | Sears, Jr. | 135/21 |
| 2,772,684 | 12/1956 | Puls et al. | 135/90 |
| 2,871,868 | 2/1959 | Faasse et al. | 135/20 R |
| 2,984,249 | 5/1961 | Sears, Jr. et al. | 135/114 X |
| 3,059,948 | 10/1962 | Thompson et al. | 403/90 |
| 3,120,238 | 2/1964 | Glatz | 135/21 |
| 3,375,044 | 3/1968 | Peterson | 403/90 X |
| 3,485,388 | 12/1969 | Bohne | 294/96 |
| 3,486,514 | 12/1969 | Prescott | 135/90 |

FOREIGN PATENT DOCUMENTS

| | | | |
|---|---|---|---|
| 3440493 | 3/1986 | Fed. Rep. of Germany | 135/21 |
| 0638210 | 4/1962 | Italy | 135/102 |

*Primary Examiner*—Robert A. Hafer
*Assistant Examiner*—D. Neal Muir

[57] ABSTRACT

A suspension umbrella has a crown connected to a holder by means of a ball joint. For arresting the ball joint in different positions the ball joint is equipped with an arresting body which is actuatable by means of a screw spindle arranged coaxially to the umbrella axis. A securing device includes a securing screw which is threaded into the crown through a bore in a sleeve in order to prevent relative movement between the crown and the sleeve or ball joint.

11 Claims, 8 Drawing Figures

SUSPENSION UMBRELLA WITH BALL JOINT SECURING DEVICE

BACKGROUND OF THE INVENTION

The invention concerns a suspension umbrella connected to a holder by means of a ball joint.

Suspension umbrellas of the foregoing type are known for example from CH-PS367290. In that case the screw spindle is threaded into a thread in a transverse wall of a sleeve of the ball joint and presses on an arresting body forming a portion of the ball socket. The screw spindle serves as a short umbrella post which carries the crown of the umbrella in its upper portion and also receives at its lower portion the sliding sleeve of the umbrella when the umbrella is in its open condition. A pivotal lever is connected to the lower end of the screw spindle which lever on one hand serves to operate the screw spindle and on the other hand serves to hold the sliding sleeve in the position corresponding to the open condition of the umbrella. It has proven disadvantageous that the crown and the sliding sleeve are freely rotatable on the screw spindle. A release of the holding of the umbrella can come about by the umbrella being rotated by the wind or by unthinking manual manipulation in the opening direction of the screw spindle. Frictional forces between the umbrella frame and the umbrella post can move these together so that they are screwed out of the ball joint allowing the umbrella to fall down.

The object of the invention is therefore to provide a suspension umbrella of the foregoing type wherein an unintentional loosening of the umbrella from its joint is prevented.

SUMMARY OF THE INVENTION

This object is solved by providing a securing device which hinders the unintentional loosening of the umbrella from the ball joint.

Such a securing device can be implemented in many different ways. It can for example be such as to prevent the screw spindle from being threadable out of the ball joint beyond a certain distance in which case the umbrella frame may be arranged rotatably on the screw spindle, a screwing out beyond a certain amount not being possible. On the other hand the securing device can also be so designed that the umbrella frame is rotatably fixed to the ball joint. In this case the turning of the umbrella frame as such is prevented so that the ability of the screw spindle to be threaded outwardly is not of primary criticality.

An especially simple solution is one where the ball joint is arranged directly on the umbrella. The ball of the joint can be directly rigidly fastened with the umbrella crown so that advantageously a portion of the ball joint is formed as an arresting body and is pressable against the ball socket by means of the screw spindle. Still more advantageous however is a design wherein the ball of the joint can remain unchanged and only the joint socket need contain an arresting body. In this case it may be desirable if the head of the screw spindle itself is formed as the arresting body.

In another embodiment the security device is such as to limit the screw spindle to a given permitted amount of movement over which it is adjustable. The umbrella frame can then be freely rotatably arranged on the screw spindle. Most importantly, a loosening of the umbrella from its joint is made difficult.

In another embodiment the free rotatability of the umbrella relative to its ball joint is prevented. The security device can for example be a securing screw which connects a part of the joint with the crown. In this case a removal of the umbrella from the joint is made difficult and intricate. This disadvantage can be eliminated by an embodiment using a torsion spring and wherein upon screwing the screw spindle into part of the ball joint the projecting ends of the torsion spring are brought into play. An especially simple removal of the umbrella from the ball joint can be provided by a security device using a bayonet type lock. An especially simple fastening of the umbrella to the ball joint is made possible by an embodiment of the security device wherein the umbrella only has to be moved into the ball joint and becomes immediately snapped in place. By operation of the snap bodies a quick simple release of the umbrella from the ball joint is guaranteed. A further very simple releaseable fastening of the umbrella to the ball joint makes use of a slot and an opening in the socket of the joint through which slot and opening the ball may be removed from the socket.

BRIEF DESCRIPTION OF THE DRAWINGS

Embodiments of the invention are described hereinafter in more detail in connection with the drawings which are.

DESCRIPTION OF THE PREFERRED EMBODIMENTS

Figure 1:
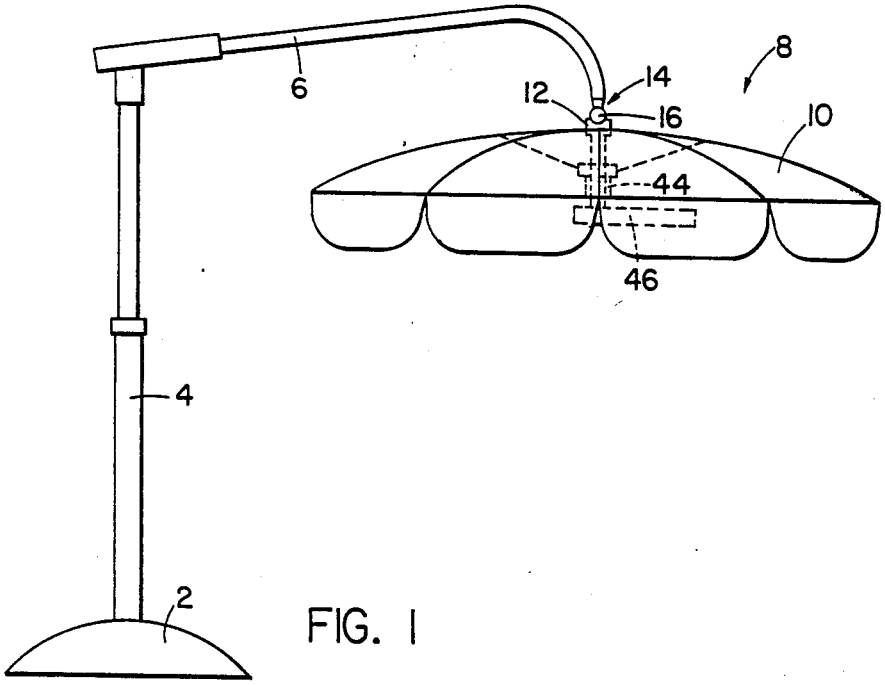
FIG. 1 is a side view of a suspension umbrella on an outrigger arm of a stand.

FIG. 1 shows a stand 4 on a base 2, which stand at its upper hand has an outrigger arm 6. A suspension umbrella assembly 8 is located at the end of the arm and includes an umbrella 10 whose crown 12 is connected with the arm 6 by means of a ball joint 14.

Figure 2:
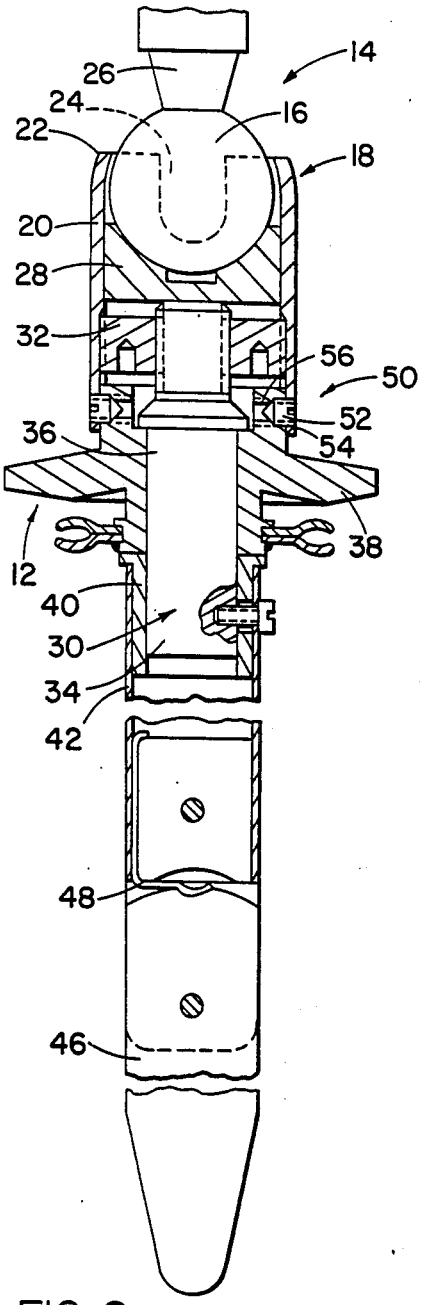
FIG. 2 is a fragmentary vertical sectional view taken through the ball joint and adjacent umbrella parts of the umbrella of FIG. 1.

FIG. 2 shows details of the ball joint 14 and of neighboring portions of the umbrella 10. The ball 16 of the ball joint 14 is fastened to the arm 6 and is supported in a socket 18. The socket 18 is formed by a sleeve 20 which grips the ball 16 at its upper end. The sleeve 20 has a lateral recess 24 for receiving the neck 26 of the ball 16 when the umbrella 10 is pivoted about 90 degrees, for example, toward the arm 6. In the sleeve 20 is an arresting body 28 which is axially slideable relative to the sleeve and which forms a further part of the socket 18. The arresting body 28 abuts against a screw spindle 30 which is screwed into a screw ring 32 coaxial to the axis 34 of the umbrella 10. Upon further screwing in of the screw spindle 30 the arresting body 28 is pressed against the ball 16 so that the ball joint 14 can be fixed in any desired position.

The screw spindle 30 is made as a threaded bolt 36 which is threaded into the screw ring 32 and which carries the crown 38 of the umbrella 10. At the lower end of the threaded bolt 36 a sleeve 42 is connected to it through a ring part 40. The sleeve 42 and the ring part 40 serve on one hand to hold the crown 12 on the threaded bolt 36 and on the other hand as a short umbrella post for receiving the sliding sleeve 44 of the umbrella 10 when the umbrella is open. A pivoting lever 46 is pivotally connected to the lower end of the sleeve 42 of the screw spindle 30, which pivoting lever in its coaxial position relative to the screw spindle is conditioned to receive the sliding sleeve 44. In its angulated position as shown in FIG. 1, the pivoting lever 46 serves on one hand to hold the sliding sleeve 44 on the screw spindle 30 and on the other hand serves as an operating handle for turning the screw spindle. A spring 48 arranged on the sleeve 42 serves to retain the pivoting lever 46 in whatever position it is moved to.

A security device 50 serves to secure the umbrella 10 at the ball joint 14, the security device being formed of security screws 52 threaded into threaded bores 56 in the crown 12 and extending through bores 52 in the sleeve 20 of the socket 18, the screws 52 therefore rotatably fixing the crown 12 relative to the socket 18.

Figure 3:
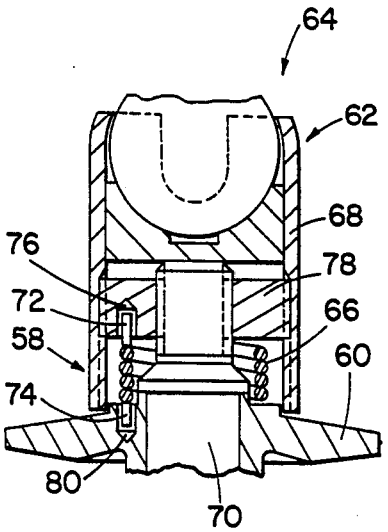
FIG. 3 is a fragmentary vertical sectional view of a ball joint having a torsion spring as the securing element.

FIG. 3 shows a further security device 58 for rotatively fixing the crown 60 with the socket 62 of the ball joint 64. In this case a helical torsion spring 66 is provided and arranged inside the sleeve 68 of the socket 62 and around the screw spindle 70. The helical torsion spring 66 has projecting spring ends 72, 74 extending parallel to the axis 34 of the umbrella, and one extends into a bore 76 in the screw ring 78 and the other extends into a bore 80 in the crown 60. The insertion of the spring ends into the bores 76 and 80 can take place when the screw spindle 70 is first assembled in the screw ring 78 of the ball joint 64.

Figure 4:
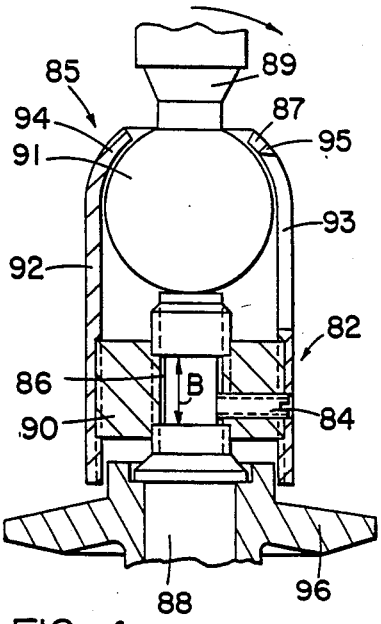
FIG. 4 is a fragmentary vertical sectional view of a ball joint with a securing screw cooperating with the screw spindle.

In the embodiment of FIG. 4 a security device 82 is provided which includes at least one security screw 84 which projects into a circumferential groove 86 of the screw spindle 88 and which is arranged in a screw ring 90 in the sleeve 92 of the socket 94. The width B of the groove 86 corresponds to the permitted movement of the spindle plus the diameter of the security screw 84. In this embodiment the crown 96 is freely rotatable on the screw spindle 88 but this can only occur until the screw spindle 88 engages the screw 84 with one side of its circumferential groove 86. The socket 94 of the ball joint 85 is provided with a slot 87 extending radially from the axis of the umbrella for the neck 89 of the ball 91 and is also provided with a lateral opening 93 for passage of the ball. A removal of the ball is therefore possible if the screw spindle 88 holding the ball 91 in the socket 94 is screwed so far out that the ball 91 may be so far displaced from the socket that it is moveable past the edge 95 of the socket and laterally out through the lateral opening 93.

Figure 5:
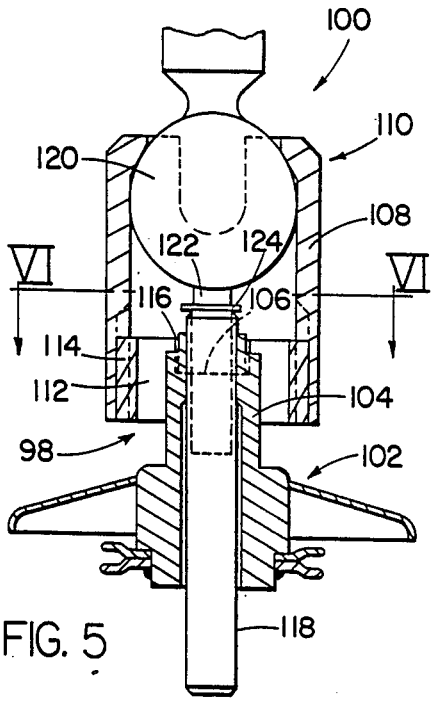
FIG. 5 is a fragmentary vertical sectional view of a ball joint with a bayonet lock as the securing device.
Figure 6:
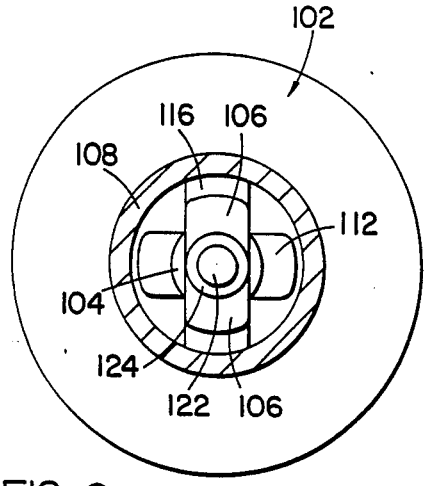
FIG. 6 is a tranverse sectional view taken on the line VI—VI of FIG. 5.

FIGS. 5 and 6 show a further device for securing against the unintentional loosening of the umbrella from the ball joint 100. The security device, which is formed as a bayonet lock, has a plug 104 arranged on the crown 102, which plug at its upper end has two diametrically opposite detent dogs 106. These are connectable with the sleeve 108 of the socket 110 as the detent dogs 106 are axially insertable in the sleeve 108 through diametrically opposite recesses 112 in an inner ring 114 of the sleeve 108. With such insertion the detent dogs 106 become positioned behind the inner ring 114 and upon lateral rotation become positioned opposite detent recesses 116 into which they are received upon tightening of the screw spindle 118. The screw spindle 118 is threaded into the plug 104 of the crown 102 and at its upper end engages the ball 120. The screw spindle 118 has at its upper end an arresting body 122 which on one hand cooperates with the ball 120 and on the other hand carries a securing ring 124 which hinders the unwanted loosening of the screw spindle 118 from the crown 102 by abutting against the upper end of the plug 104 after the screw spindle is threaded a certain amount in the loosening direction relative to the crown 102.

Figure 7:
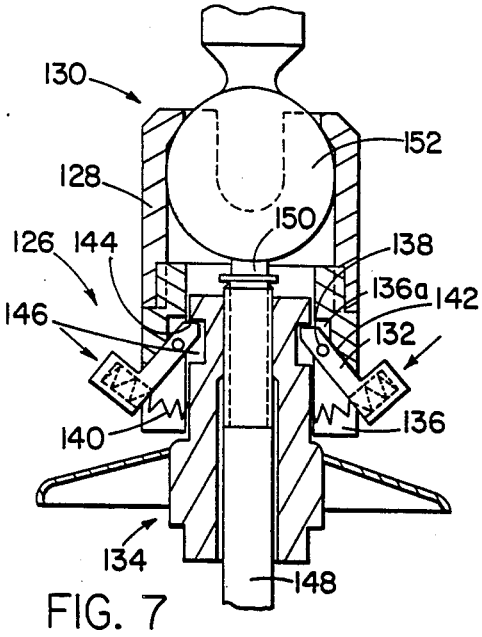
FIG. 7 is a fragmentary vertical sectional view of a ball joint having a snap device as the securing mechanism.
Figure 5A:
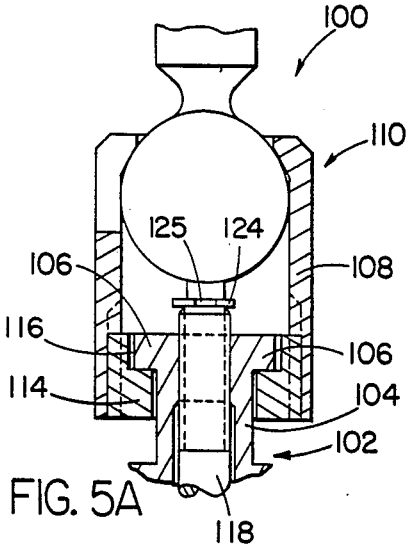

FIG. 7 shows a further securing apparatus 128 which is formed as a snap device. In this case the snap bodies 132 are arranged in the sleeve 128 of the socket 130 around its circumference, which snap bodies extend in the direction of movement of the crown 134. The inclined snap bodies are pivotally supported in slots 136 of the sleeve 128 on pins 138. Compression springs 140 bias the snap bodies 132 against stops 142, against which the snap bodies will then stand when the crown 134 is in place in the sleeve 128. The inwardly extending ends 144 of the snap bodies 132 extend into return arresting recesses 146 formed for example by an annular groove in the plug of the crown 134. The screw spindle 148 again carries at its upper end an arresting body 150 which cooperates with the ball 152. The screw spindle 148 is again threadably supported in the plug of the crown 134.

Figure 8:
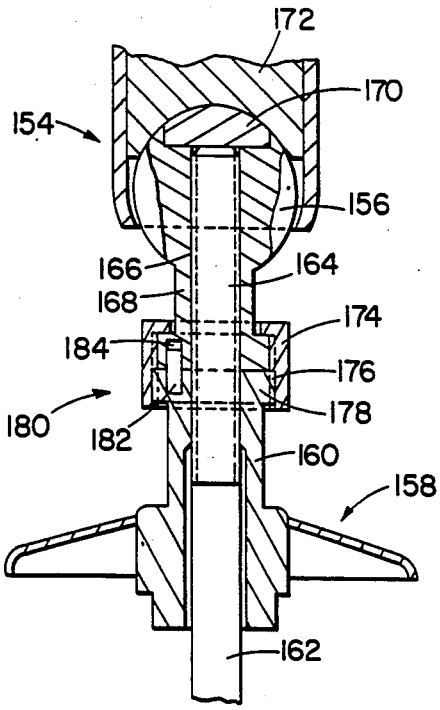
FIG. 8 is a fragmentary vertical sectional view of a ball joint in which the ball is arranged on the crown of the umbrella.

FIG. 8 shows a further embodiment of a ball joint 154 wherein the ball 156 is connected with the crown 158. In this case the crown 158 has an upwardly extending column 160 in which the screw spindle 162 is rotatably threadably supported in cooperation with a thread 164. The screw spindle protudes beyond the column 160 and extends into a bore 166 in the neck 168 of the ball 156 to an arresting body 170 which forms a section of the ball and which is moveable radially outwardly by means of the screw spindle 162 to become compressed against the socket 172. The connection of the column 160 of the crown 158 to the neck 168 of the ball takes place through a union nut 174 positioned over the neck 168 and which union nut is threaded on to the external thread 176 of a flange 178 on the column 160.

To avoid a loosening of the flange connection and therewith disconnection of the umbrella from the ball joint a securing device 180 is provided. This includes a pin 182 arranged in the forward side of the flange 178 which pin extends into a bore 184 in the neck 168 of the ball before the connection is made by means of the union nut 174.

Many further embodiments of the invention are also imaginable. Further, features of the foregoing embodiments are exchangeable with one another and can be supplemented.

I claim:

1. A suspension umbrella assembly wherein an umbrella is suspendable from a holder through a ball joint mechanism, said assembly comprising an umbrella having a central axis and a crown surrounding said central axis, a ball joint mechanism, and means connecting said ball joint mechanism to said crown, said ball joint mechanism being connectable to a holder for suspending said umbrella from the holder and said ball joint mechanism permitting said umbrella to be pivoted relative to the holder and to be arrested in any given position relative to the holder, said ball joint mechanism including an arresting body for arresting the mechanism in any given position, said arresting body being actuatable between arresting and loosened conditions from below said ball joint mechanism by means of a screw spindle arranged coaxial to said central axis, said means for connecting said ball joint mechanism to said crown including two parts which are disconnectable from one another when said arresting body is in its loosened condition to detach said umbrella from said ball joint mechanism, and said means for connecting said ball joint mechanism to said crown further including a security device releasably interengageably connected between said two parts of said connecting means to inhibit unintentional disconnection of said two parts of said connecting means.

2. A suspension umbrella assembly according to claim 1 further characterized in that the ball of the ball joint mechanism is arranged so that a portion of the ball is pressable against the joint socket as an arresting body by means of the screw spindle.

3. A suspension umbrella assembly according to claim 1 further characterized in that the joint mechanism socket of the ball joint is arranged so that preferably a portion of the joint socket is pressable against the ball as an arresting body by means of the screw spindle.

4. A suspension umbrella assembly according to claim 1 further characterized in that said screw spindle has a head formed to provide said arresting body.

5. A suspension umbrella assembly according to claim 1 further characterized in that the securing device includes at least one securing screw arranged in one of said two parts of said connecting means and which screw engages in a circumferential groove in the screw spindle, the width (B) of the groove corresponding to the permitted path of movement of the spindle plus the diameter of the securing screw.

6. A suspension umbrella assembly according to claim 1 further characterized in that the securing device includes a means for nonrotatably connecting the crown with a part of said joint mechanism.

7. A suspension umbrella assembly according to claim 6 further characterized in that the means for nonrotatably connecting the crown with a part of said joint mechansim includes a helical torsion spring with projecting spring ends extending parallel to said axis of said screw spindle which spring ends are received in bores extending parallel to said axis in said crown and in said sleeve.

8. A suspension umbrella assembly according to claim 1 further characterized that the securing device is formed as a bayonet lock between the crown and a part of the ball joint mechanism, the bayonet lock having detent recesses for receiving detent dogs.

9. A suspension umbrella assembly according to claim 8 further characterized in that a sleeve of the joint socket includes an inner ring which inner ring contains first recesses for the axial passage there through of said detent dogs and also includes said detent recesses which are displaced angularly about said control axis from said first recesses for receiving said detent dogs.

10. A suspension umbrella assmbly according to claim 1 further characterized in that said ball joint includes a ball and a sleeve forming a joint socket receiving said ball, said sleeve being arranged on the umbrella, and in that the securing device includes a snap mechanism which includes snap bodies spaced angularly around said central axis and arranged on said sleeve, said snap bodies extending in the direction parallel to said central axis and being biased so that first ends thereof are biased radially inwardly relative to said sleeve toward said central axis so as to enter as detents into a recess in a neck portion of the crown.

11. A suspension umbrella assembly according to claim 1 further characterized in that a socket of the ball joint mechanism on a side thereof generally parallel to said central axis includes a slot extending therethrough radially of said central axis for receiving the neck of the ball joint, and which slot extends generally parallel to said central axis to an opening in said side of the socket for the passage of the joint ball so that when th scren spindle is loosened a lateral removal and insertion of the joint ball relative to the joint socket is possible.

* * * * *